United States Patent [19]

Mabrouk et al.

[11] 4,130,056

[45] Dec. 19, 1978

[54] LITHOGRAPHIC MOISTURE SYSTEM AND METHOD

[75] Inventors: Saied A. Mabrouk, Macedonia; Edward T. Morgan, Mentor, both of Ohio

[73] Assignee: Addressograph-Multigraph Corporation, Los Angeles, Calif.

[21] Appl. No.: 820,760

[22] Filed: Aug. 1, 1977

[51] Int. Cl.[2] ..... B41F 7/24; B41L 25/00

[52] U.S. Cl. ..... 101/141; 101/147; 101/350; 101/451

[58] Field of Search ..... 101/141, 147, 148, 350, 101/451

[56] References Cited

U.S. PATENT DOCUMENTS

| | | | |
|---|---|---|---|
| 738,821 | 9/1903 | Linder | 101/148 |
| 2,981,180 | 4/1961 | Crissy | 101/147 |
| 3,048,098 | 8/1962 | Siebke | 101/148 |
| 3,368,483 | 2/1968 | Storms | 101/450 |
| 4,029,008 | 6/1977 | Mabrouk | 101/148 |

*Primary Examiner*—Clyde I. Coughenour
*Attorney, Agent, or Firm*—Michael A. Kondzella; George Jameson

[57] ABSTRACT

A moisture control feed system of the bare-back type in which there is in nip-contact with a moisture transfer roll and the moisture transfer roll is driven solely by the shear resistance offered by the intervening layers at the nip of the ink and the moisture. The system includes an ink reservoir that simulates an oleophilic image in the form of a narrow strip extending transverse the direction of rotation of the master cylinder and is located outside the master retention area to supply ink to the oleophilic moisture form roll. The simulated image maintains the proper ink layer thickness on the oleophilic moisture form roll and the ink quality to assure proper rotational speed control of the transfer roll.

5 Claims, 3 Drawing Figures

LITHOGRAPHIC MOISTURE SYSTEM AND METHOD

BACKGROUND OF THE INVENTION

This invention relates generally to controls for moisture feed systems in lithographic duplicators and, more particularly, relates to systems in which the moisture carrying form roll also attracts ink.

It is conventional in the construction of the moisture feed systems for lithographic duplicators to use a moisture form roll that is ink receptive. The moisture form roll can therefore carry ink as well as apply moisture. Such systems have been referred to as "bare-back systems" for the reason they obviate the need for the well known molleton covered form roll. Molleton covers, as is well known in this art, are made of cloth which soaks up moisture and serves as a reservoir to apply moisture to the master.

In the bare-back system, the master has moisture applied from the special moisture form roll to its water-receptive areas.

In the start-up operation of a bare-back moisture feed system, the moisture form roller receives a layer of ink usually by permitting ink to be applied to the metal surface of the master cylinder. The cylinder is then cleaned and a fresh moistened master then receives ink application from the ink form roller. The duplicating process of running the master through the cycle on the machine causes a certain amount of ink to be exchanged between the image portions of the master and the ink layer of the moisture form roller.

The layer of ink which ultimately accumulates on the moisture form roller appears to promote uniformity in its surface characteristics and thereby improve its properties as a moisture forwarding agent. It will be understood that the layer of ink on the moisture form roller is important to its operation in this connection and, therefore, the character of the ink layer itself is important.

It has been found that the oleophilic character of the moisture form roller provides the necessary environment to control the moisture supply by means of a frictionally responsive moisture transfer roll. The moisture transfer roll acts as a valve between the moisture supply and the moisture applying element, namely, the moisture form roller. The oleophilic moisture form roll is made to run in rolling contact with the moisture transfer roll whose surface is primarily hydrophilic, and which is driven solely by a nominal or non-film control pressure contact between its surface and that of the ink covered moisture form roll via the clear resistance offered by the intervening layers of the ink and the moisture. The detailed description of the valve control function carried out by the moisture transfer roll in the bare-back type moisture system of a lithographic duplicator is described in detail in co-pending applications Ser. Nos. 682,855 and 689,165, both filed in the name of S. A. Mabrouk and assigned to the same assignee as the instant invention. The aforementioned pending applications are concerned with the feeding of moisture to the transfer roll by a supply system which provides a proper moisture flow allowing the transfer roll to accept from the system the amount of moisture which is currently required as a function of its speed of rotation and which speed of rotation is governed by a mechanism applying a restraining torque to the rotation of the transfer roll. The mechanism is characterized by exerting a restraining effect which increases monotonically as the speed of the transfer roll rotation increases.

Hence, it will be seen that the character and quality of the ink layer on the moisture form roller is important, since as explained earlier, the moisture transfer roller is driven solely by the shear resistance offered by the intervening layers of ink and moisture.

SUMMARY OF THE INVENTION

The present invention provides an ink carrying element within the ink and moisture supply system which brings ink to the oleophilic moisture form roller during each printing rotation of the machine. The ink carrying element is a narrow ink carrying strip positioned on the master cylinder in an area which is outside the master retention area of the cylinder and extending the full width of the cylinder in a direction transverse to its direction of rotation. In carrying out the invention, the ink carrying element is mounted within the space formed in the master cylinder adapted to receive the clamping elements for retaining the lithographic master at its lead edge and tail edge but occupying the space created by eliminating the tail clamp which is not normally used in systems applications. The transverse ink carrying element is disposed within the cylinder gap and is adjustably mounted on a suitable support bracket. It is adjustable so that it can be raised and lowered to bring its working surface within the same plane as the ink receptive portions of the lithographic master. In other words, it takes into account the several mil thickness of the master. By maintaining the surface of ink carrying strip in the same plane as the ink receptive portions of the master, it is treated the same way as an image portion and will be assured of having applied an amount of ink from the ink form roller in much the same way as an image.

The material which forms the ink carrying strip may be any suitable material which will have dimensional stability such as extruded aluminum, or other metal or plastic whose surface is oleophilic. In order to achieve the oleophilic condition on the surface of the strip, it may be covered with a Teflon tape or similar coating, Teflon being a highly ink receptive material. Other ink receptive materials may be used to good advantage, such as brass, rubber, or a ferrous metal. It will be appreciated that the materials of construction necessary to carry out the invention are well known in this art and, therefore, the material selection can routinely be accomplished.

The ink carrying strip as provided on the master cylinder becomes part of the ink and moisture system of the duplicator. As stated earlier, the criticality of the quality and character of the ink layer on the moisture form roller is significant if the moisture transfer roller is to perform its valve function in controlling the delivery of moisture to the moisture form roller. If the ink layer on the moisture form layer becomes depleted or excessively contaminated with paper lint and the various chemical solutions applied to the master, it will, within a short period of machine operation, degrade so that the shear resistance offered by the intervening layer of moisture will tend to be overridden, giving an erroneous level of driving torque to the rotation of the moisture transfer roll. Where the master has a relatively large image area, the ink carried in that image area will comingle with the ink on the moisture form roller and dilute the contaminated ink with fresh ink. This has a stabilizing effect on the quality and character of the ink layer. However, in the circumstance that the image coverage on the master is small, then the opportunity for keeping the ink fresh is very limited so that it would bein to degrade due to migration and/or contamination as described hereinabove.

The ink carrying strip located on the master cylinder will become part of the system because it will take ink from the ink form roll as would an image and through contact with the moisture form roller exchange quantities of ink so as to provide some fresh ink.

It is, therefore, a general object of this invention to provide an improved moisture control system dependent on the quality and character of the ink layer on the moisture form roller.

It is a specific object of this invention to simulate an ink receptive image area on the master cylinder of the duplicator to carry ink from the ink supply system to the ink layer on the moisture form roller as a source of fresh ink thereby stabilizing the quality and character of the ink layer.

Other objects and advantages of the ink and moisture system of this invention will become apparent from the following detailed description.

DETAILED DESCRIPTION

Figure 1:
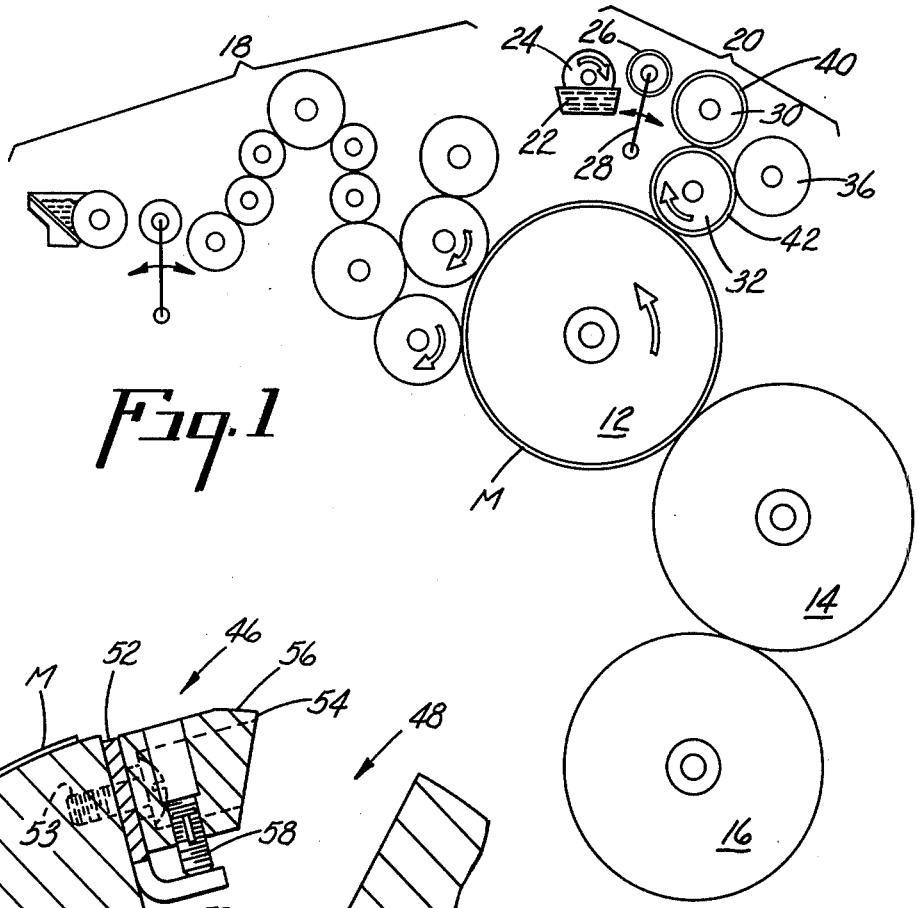
FIG. 1 is a schematic representation of the ink feed and moisture feed of a duplicating apparatus of this invention.

Referring to the drawings and, more particularly, to FIG. 1, there is shown the series of cylinders which are responsible for carrying out the lithographic duplicating function specifically the cylinder carrying the lithographic master, the offset blanket, and the impression cylinder which causes the ink image to be transferred to the impression paper, identified, respectively, as 12, 14 and 16.

Working in relation with the cylinders are an ink train 18 and a moisture train 20.

The moisture train 20 includes a fountain 22 receiving a fountain roll 24 having an hydrophilic surface, a ductor roll 26 mounted on an oscillating arm 28, and a moisture transfer roll 30 which has a hydrophilic surface. The transfer roll is in contact with the surface of a moisture form roll 32 having an oleophilic surface which runs in contact with a master on the surface of the master cylinder 12. A reciprocating distributor roll 36, likewise oleophilic, rides in contact with the moisture form roll 32 and by an internal cam mechanism shifts axially back and forth to level the ink layer and the moisture deposit on the surface of the form roll 32 in a well known manner. One form of such cam mechanism is fully described in U.S. Ser. No. 682,855 copending with this application and assigned to the same assignee as the instant invention.

Referring to the fountain roll 24, in its typical construction this roll is made of metal, such as, for example, aluminum with a matte surface, or has a tin nickel plating or chrome plating on an aluminum or steel base. It is to be understood that other hydrophilic materials may be used for the fountain roll, including non-metallic composition.

It is conventional in such a moisture system to use as one control for delivering controlled quantities of moisture a ductor roll 26 whose surface must be adequately hydrophilic and oleophobic when wet and must exhibit significant moisture attracting and carrying properties. In the more conventional system, such a roller surface is covered with a molleton cloth which has such certain moisture retaining properties. The preferred surface for such a roll is a synthetic elastomeric composition which has dispersed therein a high percentage of short fibers whose suitable composition of such is regenerated cellulose, which presents a more matte surface and is appropriately water receptive.

The fountain roll 24 is stepped by a suitable ratchet means (not shown) operating in timed relation with the rotation of the master cylinder 12 at a rate which is adjustable between 0 RPM and 30 RPM, to provide for an increase or decrease in the amount of moisture being delivered by the system. A setting of about 10 to 20 RPM is representative for usual amount of moisture delivery under most applications which are carried out at the customary machine speeds.

Referring further to FIG. 1, the fountain roll 24 is incrementally moved in a rotary direction opposite to the rotation of the transfer roll 30. It will be observed that the direction of rotation of the ductor roll reverses itself as it moves between the fountain roll and the transfer roll. The fountain roll 24 is connected to a conventional adjustable drive mechanism (not shown) so as to incrementally rotate while partially immersed in the water containing fountain 22. This type of control for the fountain is conventional and well known in this art and need not be described in further detail here.

Similarly, the oscillating motion of the arm 28 which carries the ductor roll 26 is driven by a conventional drive from the duplicator mechanism. The arm oscillates at a fairly high rate, for example, about 2.8 cycles per master revolution or about 7 cycles per second for machine speeds currently in common use.

The moisture form roller 32 is smooth surfaced and of a rubber-like material, preferably a synthetic elastomer having a hardness durometer in the range of 20–40 units on a Shore A scale. The roll 32 is driven by conventional gearing and preferably at the same surface speed as the master cylinder 12. Running in friction contact with the form roll 32 is a distributor roll 36 which is also made of a material similar to that for the roller 32.

The transfer roll 30 is constructed of a material providing a suitable hydrophilic surface as discussed earlier in connection with the description of the hydrophilic fountain roll 24, and is driven only by making contact with the form roll 32 via the nip between itself and the roll 32 resulting from the frictional force created therebetween through the ink and moisture films carried on the moisture form roll. In normal operation, the transfer roll 30 carries a film of moisture 40 on its surface. This moisture is supplied and continuously replenished by the fountain roll and ductor system and as the transfer roll 30 rotates, it transfers a portion of this film via the ink layer 42 to the surface of the master M on the master cylinder 12. The exact mechanism by which moisture is carried to the surface of the master by the ink layer on the moisture form roller is not fully understood but its capacity to carry moisture is clear from the successful operation of the system.

As is fully described in the copending application Ser. No. 682,855, it is the thickness of the moisture film 40 within the nip of the rolls 30 and 32 that controls the speed of the moisture transfer roller 30. As the moisture layer increases in thickness, the torque necessary to generate shearing action in the film 40 decreases so that the drive becomes less positive and the roll 30 tends to exhibit increased slip and to turn more slowly. On the other hand, as the moisture layer decreases in thickness, the torque necessary to generate shearing action in the film 40 increases so that the drive becomes more positive and the roll 30 tends to speed up. If the roll 30 has no significant film and dries out completely, it will be driven directly through the film of lithographic ink 42 on the roll 32.

It will be appreciated, as has been described earlier, there is essentially very little or no pressure between the rolls 30 and 32 and there is just enough contact to ensure an effective drive that virtually would render the surface speeds of the two rolls 30 and 32 equal if the moisture film was absent. As such, the pressure in question is identified as nominal or "non-film-control pressure."

This variation in speed of the moisture transfer roller, as a function of the thickness of the moisture layer, provides an improved type of moisture application for lithographic duplicators which avoids the overrun problems assignable to molleton or other reservior type systems and, on the other hand, provides a quick response device which, nevertheless, avoids undue sensitivity and affords operating latitudes sufficient in amount that moisture settings can be easily made without undue demands on the skill of the operator.

Up to this point the description has dealt with the improved moisture application involving the moisture transfer roll 30, which is the subject of the invention in U.S. Ser. No. 682,855.

This invention is concerned with controlling the character and quality of the ink layer 42 on the moisture form roller since it significantly influences the rate at which the increase or decrease in the surface velocity of the moisture transfer roller will occur as a function of the thickness of the moisture layer. In other words, the quality of the ink layer determines how uniformly the driving torque responds to the value of the thickness of the moisture layer 40. It is, therefore, desirable and necessary that the ink layer by replenished with a sufficient amount of unadulterated ink so that the change in torque value is not affected by a material layer 42 which is deficient in amount or which varies in composition, but only by virtue of the moisture thickness layer and a fairly constant ink layer.

The optimum operation of the moisture transfer roller is achieved when the ink layer 42 on the moisture form roller 32 is of a quality level similar to fresh ink charged into the ink fountain. Through operation of the duplicator the layer 42 becomes contaminated as a result of normal machine operation. One such source of contamination is the pick-up of solvent employed to clean any residual ink image on the blanket. Understandably, such small amounts of solvent tend to have a dilution and removal effect on the ink layer and therefore to change its character and reduce its thickness. Another source of contamination is the conversion solution used to treat the masters to render the non-image areas hydrophilic. These conversion solutions contain a number of different soluble components which, when mixed with the ink, have a deleterious effect. Finally, there is the accumulation of paper lint in the system, some of which finds its way onto the moisture form roller surface which again changes the character of the layer 42.

The problem of contamination of the ink layer on the master form roller can be dealt with, and the ink layer can be revitalized to its optimum level of quality in the circumstance that a heavy usage of ink is called for by a duplicating job in which the master has a high ink coverage. As the moisture form roller rolls over a large ink area, there will result an interchange of fresh ink for contaiminated ink during each cycle so the quality level of the ink layer 42 is maintained. However, where there is a very low coverage on the master, supply of fresh ink does not take place at a sufficient rate to counteract the depletion or contamination. This, then, can result in an independent effect upon the torque value between the ink layer and the moisture transfer roller so that in certain situations a greater amount of moisture is fed to the roller than the amount normally required by the system to provide the proper balance between ink and moisture on the lithographic master surface.

In order to provide a steady state condition in terms of the quality of the ink layer 42, there is provided an ink receptive area on the master cylinder which participates in the duplicating cycle with the exception of imparting the image to the impression paper.

Figure 2:
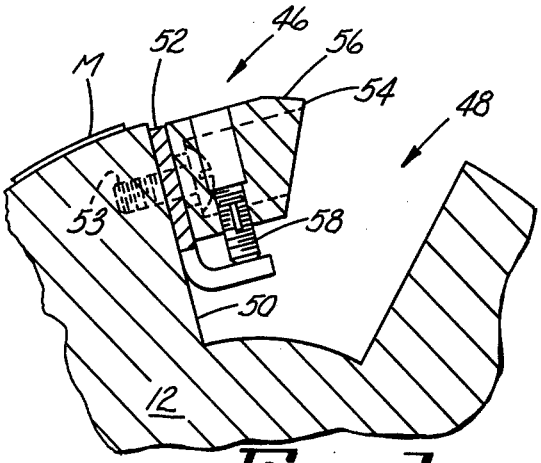
FIG. 2 is an enlarged detail in cross section of the construction of the master cylinder showing the ink carrying strip.
Figure 3:
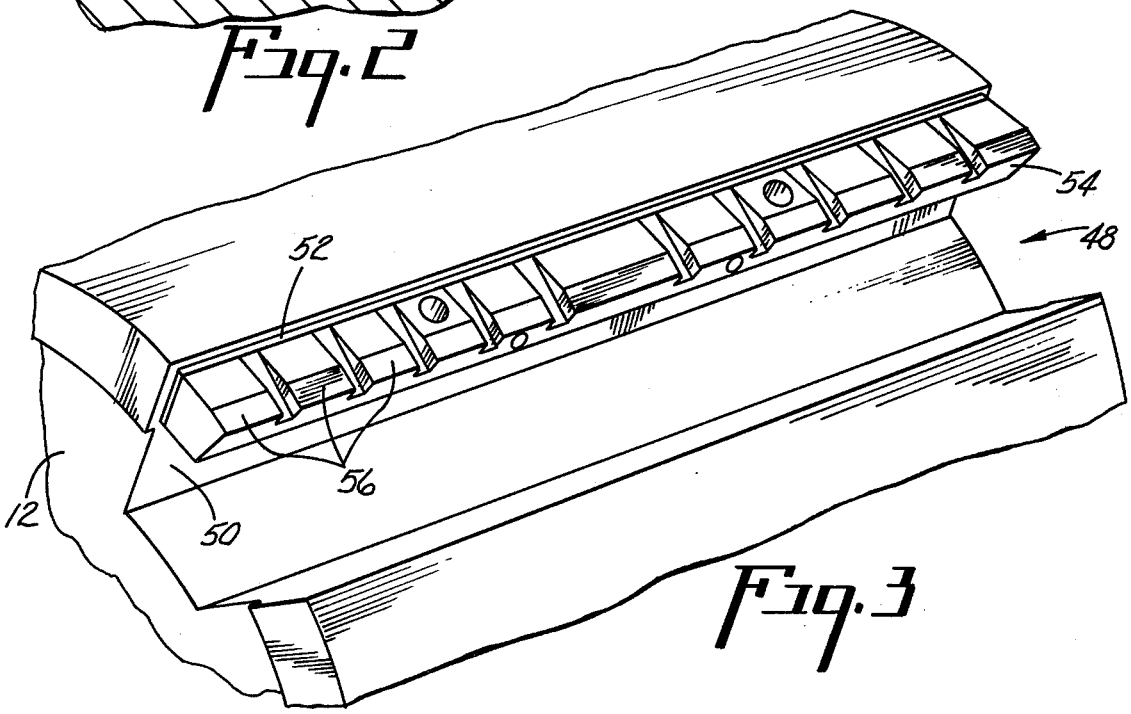
FIG. 3 is a perspective of the master cylinder showing one form of the ink carrying strip.

Referring now to FIGS. 2 and 3 of the drawings, there is shown the controlled ink carrying strip assembly of this invention identified generally as 46, which is mounted within the space 48 formed in the master cylinder ordinarily adapted to receive the clamping elements for the lithographic master at its lead and tail edge portion. The controlled ink carrying strip assembly 46 is disposed on the inside wall portion 50 within the space 48. It is the inside wall portion 50 on which the tail clamp, which clamp is not here required, would normally be mounted. The assembly 46 is made up of an L-shaped bracket 52 on which is adjustably mounted a longitudinal strip 54 which is an aluminum extrusion having a segmented top surface 56 (FIG. 3) which is the ink carrying portion of the assembly. The segmented top surface 56 of the strip 54 is machined so that it has a radius of curvature equal to the radius of the master cylinder 12. The oleophilic condition of the surface is accomplished by applying a fluorocarbon polymer or any other known material which possesses a high degree of ink receptivity.

The strip 54 is slidably secured to the L-shaped bracket 52 by means of threaded fasteners 53 passing through slotted openings and which is adjustable in a radial direction relative to the master cylinder via the screw 58. It will be appreciated that the ink carrying strip and, in particular, the surface 56 has been created to simulate an image portion on the master cylinder in much the same way as if it were carried by the master itself. It, therefore, becomes important that its surface lie in the same plane as the surface of the master so that the ink form roller as it applied ink to the image portions on the master will similarly roll over the surface 56 imparting a layer of ink. However, it is outside the actual master retention area of the master cylinder. The adjustability feature takes into the account the importance of having the proper pressure relationship between the master cylinder and the ink form roller in order that the proper amount of ink be deposited onto the image. Hence, the positional relationship between the surface 56 relative to the actual image-bearing portions of the master is important so the same pressure relationship obtains between the ink form roller and all ink receptive areas on the master cylinder.

In the typical operation of a duplicator, an imaged and treated (converted) master would be clamped (clamp is not shown) in place on the master cylinder which has been treated to render the background area hydrophilic. The moisture form roller 32 (FIG. 1) will have imparted to it an ink layer. In order to impart such an ink layer to the moisture form roller 32 when first setting up a duplicator which is clean of ink, the following procedure is one of several that may be used. To roller 32, clean of ink, is imported the layer 42 by placing the ink train 18 in a feed condition and dropping the ink form rollers into contact with the surface of cylinder 12 prior to clamping the master in place. Then the moisture form roller 32 is lowered to the surface of the cylinder 12 with the moisture feed turned off. Thus the master cylinder receives a deposition of ink which, in turn, is transferred to the moisture form roller 32. The master cylinder is then cleaned up by raising the ink form rolls and turning on the moisture feed, and the treated master M, as mentioned earlier, is clamped on the master cylinder. To start the duplicating cycle, the moisture form roller is set to the feed position, and it will apply a layer of moisture from the roller 32 followed by the application of ink from the inking system 18 by contact with the ink form roller which applies ink to the oleophilic portions of the master.

As the inking system 18 applies ink to the image area of the master, it also applies ink to the segmented surface 56 of the strip 54 so that it, too, receives ink in much the same way as if it were an image. Each cycle of the master cylinder will have caused ink to be applied to the image portions as well as to the surface 56 which in turn contacts the moisture form roller 32 which undergoes an ink exchange with the ink on the master but also with the ink layer applied to the surface 32.

Hence, the assembly 46 simulates an image portion but does not participate in the transfer of ink to the blanket and thence to the impression paper for the reason that it is outside the area that would transfer ink to the blanket and serves only as a source of fresh ink to the layer 42.

The net result of the utilization of the ink carrying strip assembly 46 is to assure a relatively stable condition of ink quality and thickness in the layer 42 so that the torque between the moisture transfer roller and the moisture form roller remains freer from aberrant influences than would otherwise occur if the layer 42 were to degrade unabated and thereby give improper moisture control.

Having described in some detail the operation of this invention, what is intended to be protected thereby is set forth in the following claims:

We claim:

1. In a lithographic duplicating apparatus having separate ink and moisture feed systems comprising roller trains;

cylinder means for retaining and holding a lithographic master in a predetermined area thereon in ink and moisture receiving relation with said feed paths;

moisture applying roll means associated with said moisture feed train for applying moisture to said master comprising an oleophilic surface capable of carrying moisture thereon;

moisture transfer roll means for feeding moisture to said moisture applying means;

means comprising oleophilic image portions for providing a continuous film of lithographic ink on said oleophilic surface;

means for positively driving said moisture applying roll in timed relation with the master cylinder of the duplicator;

means for applying to said transfer roll a retarding torque whose value varies monotonically with the speed of the rotation of the transfer roll;

said transfer roll being maintained in cooperating relationship with said moisture applying roll to form a nip therewith and being driven thereby through the layers of ink and moisture at said nip, and said relationship together with said means for applying said retarding torque controlling the surface speed of said transfer roll relative thereto and thereby the rate at which moisture is forwarded by said feed train;

the improvement comprising an ink reservoir in the form of an oleophilic band extending transverse the direction of said master cylinder in a location outside the master retention area for providing a supplemental source of ink for said moisture applying roll in addition to said oleophilic portions.

2. The apparatus as claimed in claim 1 in which the ink reservoir is adjustably mounted so that said oleophilic band can be raised and lowered relative to said ink feed system.

3. The apparatus as claimed in claim 2 in which said oleophilic band has a radius of curvature substantially the same as said master cylinder.

4. The apparatus as claimed in claim 2 in which the oleophilic surface is treated with a fluorocarbon material.

5. A method for providing controlled amounts of moisture to a master on the master cylinder of a lithographic duplicator comprising the steps of:

feeding ink to said master along an ink feed-supply system including a roller train;

feeding moisture to said master along a moisture feed-supply system including a roller-train; said moisture feed-supply system including at least as part of said roll train a positively driven moisture form roll with an ink-receptive surface and a hydrophilic transfer roll in driven, nip-forming, surface contact with the ink-receptive roll so that the latter acts as the sole driving influence on the transfer roll;

applying and maintaining on the ink-receptive surface of said form roll a continuous film of lithographic ink supplied from the oleophilic image portions of said master;

applying to said transfer roll a retarding torque whose value varies monotonically with the speed of rotation of the transfer roll;

controlling the driving effect of the nip contact between the transfer roll and the ink receptive roll through the medium of an appropriate moisture layer and ink layer on said rolls respectively and the application of said retarding torque; and controlling the thickness and quality of said ink layer by providing an ink reservoir in the form of an oleophilic band extending transverse the direction of said master cylinder in a location outside the master retention area for providing a supplemental source of ink for said moisture-applying roll in addition to said oleophilic portions.

* * * * *